US007547340B2

(12) United States Patent
Park

(10) Patent No.: US 7,547,340 B2
(45) Date of Patent: Jun. 16, 2009

(54) DUST COLLECTING UNIT OF VACUUM CLEANER

(75) Inventor: Tae Jin Park, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 586 days.

(21) Appl. No.: 11/297,423

(22) Filed: Dec. 9, 2005

(65) Prior Publication Data

US 2006/0123749 A1 Jun. 15, 2006

(30) Foreign Application Priority Data

Dec. 14, 2004 (KR) ..... 10-2004-0105485

(51) Int. Cl.
*B01D 50/00* (2006.01)

(52) U.S. Cl. ..... 55/429; 55/433; 55/DIG. 3

(58) Field of Classification Search ..... 55/337, 55/428, 429, 432, 433, 459.1, DIG. 3
See application file for complete search history.

(56) References Cited

U.S. PATENT DOCUMENTS 2,714,426 A 8/1955 White
2003/0037406 A1 2/2003 Wright et al.

FOREIGN PATENT DOCUMENTS

| | | | |
|---|---|---|---|
| DE | 101 10 581 | A1 | 11/2001 |
| EP | 1023864 | A2 | 8/2000 |
| EP | 1136028 | A2 | 9/2001 |
| EP | 1214903 | A2 | 6/2002 |
| FR | 2 810 528 | A1 | 12/2001 |
| JP | 2002-51950 | A | 2/2002 |
| JP | 2003-190056 | A | 7/2003 |
| RU | 2 228 704 | C2 | 11/2003 |

*Primary Examiner*—Robert A Hopkins
(74) *Attorney, Agent, or Firm*—Birch, Stewart, Kolasch & Birch, LLP

(57) ABSTRACT

There is provided a dust collecting unit of a vacuum cleaner, the dust collecting unit being designed to increase the density of foreign substances collected in a dust collection container. In the dust collecting unit, a dust collection container collects foreign substances, a top cover closes a top of the dust collection container, a bottom cover closes a bottom of the dust collection container, a compartment plate divides an inner space of the dust collection container into a foreign substance separating compartment and a foreign substance storing compartment, and a bar pushes the compartment plate to the foreign substance storing compartment to compress the foreign substances stored in the foreign substance storing compartment.

19 Claims, 5 Drawing Sheets

DUST COLLECTING UNIT OF VACUUM CLEANER

BACKGROUND OF THE INVENTION

1. Field of the Invention

The present invention relates to a vacuum cleaner, and more particularly, to a dust collecting unit that is installed to a vacuum cleaner to collect foreign substances such as dust and dirt. The present invention further relates to a dust collecting unit of a vacuum cleaner, in which collected foreign substances are compressed to reduce cleaning frequency of the collecting unit and prevent user's discomfort caused by the dust generating when the collected foreign substances are removed.

2. Description of the Related Art

A typical vacuum cleaner includes a suction nozzle unit to suck air containing foreign substances such as dust and dirt while the suction nozzle unit moves along a floor, a main body in which a motor and a fan are installed to generate air suctioning force through the suction nozzle unit, a dust collecting unit detachably installed to the main body to filter out the foreign substances, and an operating unit mounted on the main body so that a user grasps the operating unit in use.

The dust collecting unit separates foreign substances from the air sucked through the suction nozzle unit. In one type of the dust collecting unit, foreign substances are collected while air containing the foreign substances passes through a porous filter. In another type of the dust collecting unit, the foreign substances are collected from the air by the cyclone effect. The present invention relates to the cyclone type dust collecting unit much more.

In the cyclone type dust collecting unit, foreign substances contained in the air fall down by the cyclone effect while air is swirled, and the fallen foreign substances are gradually accumulated. When the foreign substances are accumulated to a certain degree, it is removed from the duct collecting unit. Since the cyclone type dust collecting unit utilizes the gravity to drop the foreign substances, the density of the accumulated foreign substances is low.

This low density of the accumulated foreign substances causes the following problems.

Since the limited space of a dust collection container of the dust collecting unit is easily filled up by the loosely accumulated foreign substances, the dust collection container should be emptied frequently, thereby causing inconvenience to users. If the dust collection container is not emptied periodically, the build up of the foreign substances disturbs the airflow and thereby lowers the collecting efficiency of the dust collecting unit.

Further, dust generates from the loosely accumulated foreign substances during the cleaning of the dust collection container. This causes health-related problems and makes the cleaning of the dust collection container more difficult.

Furthermore, when the collected foreign substances are spread throughout the dust collection container, the outer appearance becomes bad to give an unpleasant feeling to the user.

SUMMARY OF THE INVENTION

Accordingly, the present invention is directed to a dust collecting unit of a vacuum cleaner, which substantially obviates one or more problems due to limitations and disadvantages of the related art.

An object of the present invention is to provide a dust collecting unit of a vacuum cleaner, which is designed to increase the density of collected foreign substances.

Another object of the present invention is to provide a dust collecting unit of a vacuum cleaner, which is designed to compress collected foreign substances at a preset position in the dust collecting unit to clearly remove the collected foreign substances, prevent generation of dust when the collected foreign substances are removed, and prevent the collected foreign substance from spreading in the dust collecting unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collecting unit of a vacuum cleaner, including: a dust collection container collecting foreign substances; a top cover closing a top of the dust collection container; a bottom cover closing a bottom of the dust collection container; a compartment plate dividing an inner space of the dust collection container into a foreign substance separating compartment and a foreign substance storing compartment; and a bar pushing the compartment plate to the foreign substance storing compartment to compress the foreign substances stored in the foreign substance storing compartment.

In another aspect of the present invention, there is provided a dust collecting unit of a vacuum cleaner, including: a dust collection container separating and collecting foreign substances; a handle formed on an outer surface of the dust collection container; a top cover closing a top of the dust collection container; a bottom cover closing a bottom of the dust collection container; and a foreign substance compressing unit receiving an external force to push the collected foreign substances to a side in the dust collection container to compress the foreign substances.

In a further another aspect of the present invention, there is provided a dust collecting unit of a vacuum cleaner, including: a dust collection container separating and collecting foreign substances; a top cover closing a top of the dust collection container; a bottom cover closing a bottom of the dust collection container; a compartment plate dividing an inner space of the dust collection container into an upper foreign substance separating compartment and a lower foreign substance storing compartment; a bar pushing the compartment plate to the foreign substance storing compartment to compress the foreign substances stored in the foreign substance storing compartment; and a filter closely disposed around the bar to further filter out the foreign substances from air passed through the foreign substance separating compartment and to guide the bar therethrough.

In a still further another aspect of the present invention, there is provided a dust collecting unit of a vacuum cleaner, including: a dust collection container separating and collecting foreign substances; a compartment plate dividing an inner space of the dust collection container into an upper foreign substance separating compartment and a lower foreign substance storing compartment; a bar pushing the compartment plate to the foreign substance storing compartment to compress the foreign substances stored in the foreign substance storing compartment; a filter closely disposed around the bar to further filter out the foreign substances from air passed through the foreign substance separating compartment and to guide the bar therethrough; a handle integrally formed with the dust collection container; and a pressing member kept in the handle to use for pushing the bar downward.

According to the present invention, the inner space of the dust collecting unit can be efficiently used by compressing the collected foreign substances. Therefore users can conveniently use the vacuum cleaner. Particularly, dust does not generate when the collected foreign substances are removed from the dust collecting unit, and the removing of the collected foreign substances from the dust collecting unit can be done less frequently but more easily.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
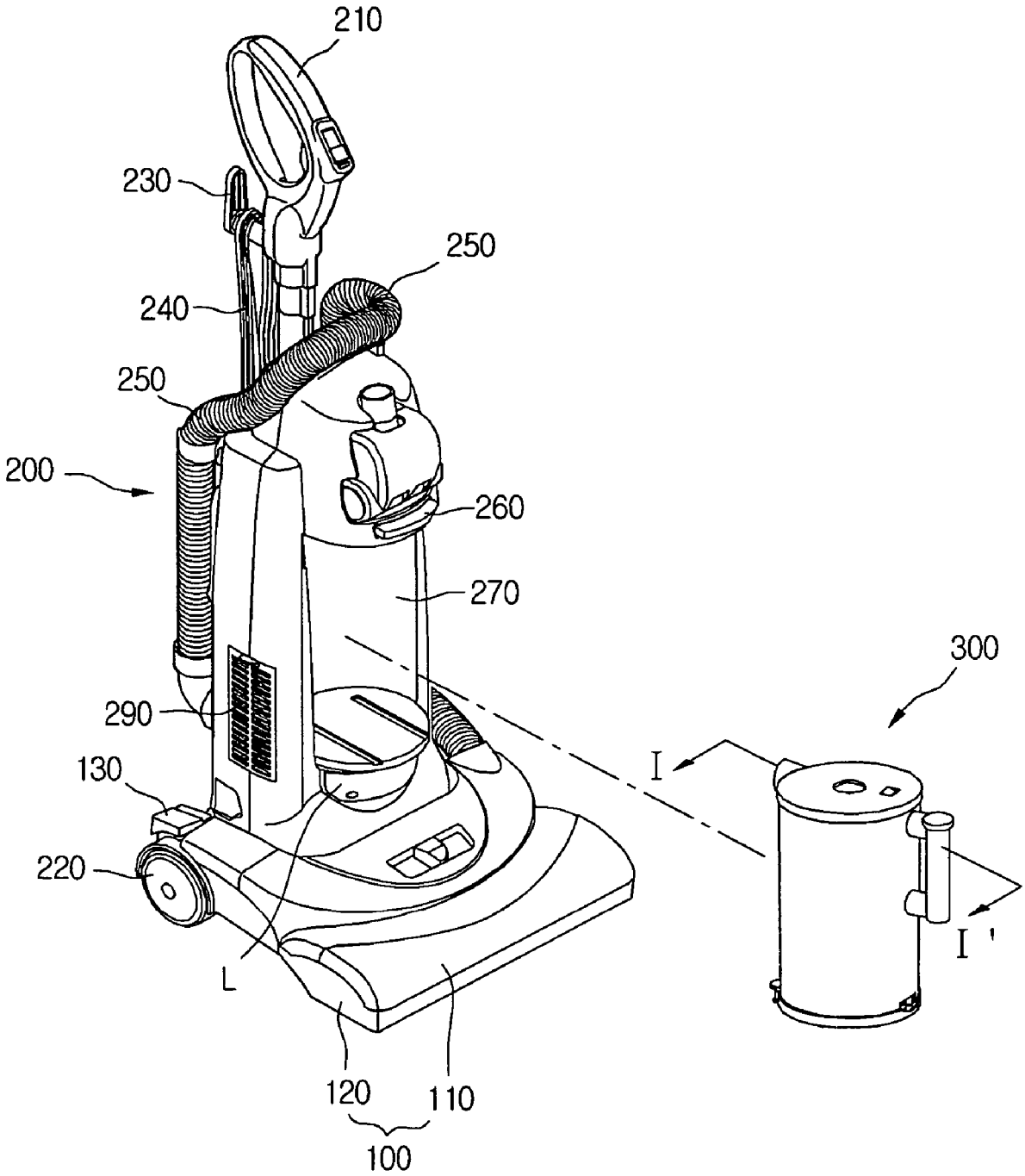
FIG. 1 is a perspective view of an upright vacuum cleaner according to an embodiment of the present invention.

FIG. 1 is a perspective view of an upright vacuum cleaner according to an embodiment of the present invention.

Referring to FIG. 1, the upright type vacuum cleaner includes a suction nozzle unit 100 sucking air containing foreign substances such as dust and dirt while moving along a floor, a main body 200 in which suction power generating components such as a motor and a fan are installed to suck the air, and an operating unit 210 mounted on a top of the main body 200 so that a user grasps the operating unit 210 in use.

Hereinafter, each component of the vacuum cleaner will be more fully described.

The suction nozzle unit 100, which is designed to suck the air, includes a nozzle upper cover 110 and a nozzle lower cover 120 that form the upper and lower outsides of the suction nozzle unit 100, respectively. The lower nozzle cover 120 defines an air intake (not shown) in a bottom surface as a main suction passage for the outside air. Further the suction nozzle unit 100 includes wheels 220 on both sides for an easy movement of the vacuum cleaner.

The main body 200 is designed to pivot rearward within a predetermined angle range with respect to the suction nozzle unit 100. To control the pivotal motion of the main body 200, a pivot lever 130 is provided on a top-rear end of the suction nozzle unit 100. Therefore, when the user steps on the pivot lever 130 and pulls the main body 200 rearward using the operating unit 210, the main body 200 is inclined rearward. Therefore, the user can adjust an angle of the main body 200 in response to his/her height.

A wire fixing member 230 is formed on a rear portion of the main body 200. Preferably, a pair of wire fixing members 230 may be formed on the rear portion of the main body 200 at up and down positions in a symmetric manner. An electric wire 240 can be conveniently wound around the wire fixing members 230.

A motor (not shown) for generating suctioning force is installed in the main body 200 to suck the outside air and foreign substances through the suction nozzle unit 100. A flexible suction hose 250 is provided on a center portion of the main body 200 to guide the foreign substances contained in the air sucked through the suction nozzle unit 100 to a dust collecting unit 300.

The main body 200 is provided with a coupling knob 260 on a front surface for separation of the dust collecting unit 300 from the main body 200. The coupling knob 260 makes interference with a portion of the dust collecting unit 300 to confine the dust collecting unit 300. Thus, the dust collecting unit 300 is not separated from the main body 200 when the coupling knob 260 is not handled. Therefore, the dust collecting unit 300 can be stably accommodated in the main body 200 when the vacuum cleaner moved for cleaning.

Under the coupling knob 260, a mounting portion 270 recessed into the main body 200 is provided. The mounting portion 270 has a shape corresponding to an outer portion of the dust collecting unit 300 to detachably receive the dust collecting unit 300.

A lamp (L) is installed under the mounting portion 270, such that the cleaning of dark places such as a corner and a place under a table can be easily carried out by turning on the lamp (L).

The overall structure and operation of the vacuum cleaner can be understood by the description above. Hereinafter, the structure and operation of the dust collecting unit 300 will be described. According to the present invention, the dust collecting unit 300 collecting foreign substances from the air sucked is characterized in that the collected foreign substances are compressed to increase the density of the collected foreign substances.

Figure 2:
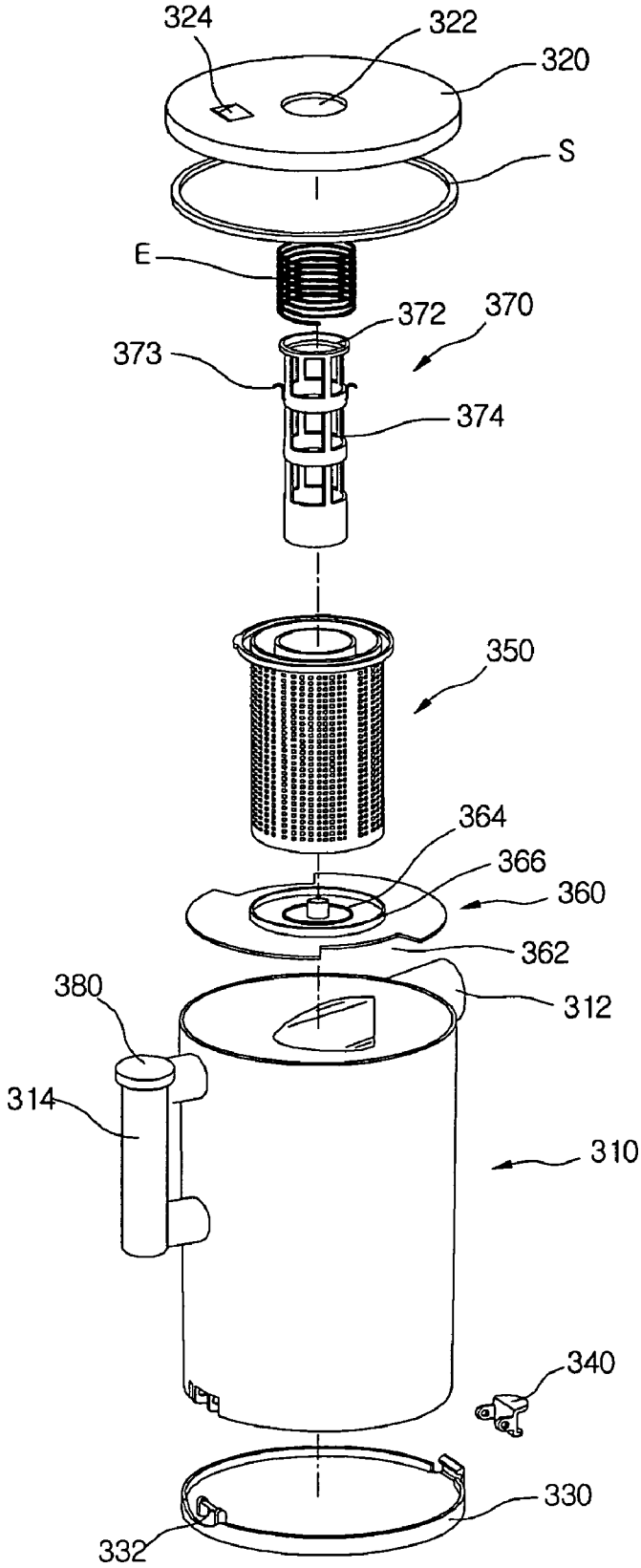
FIG. 2 is an exploded perspective view of a dust collecting unit of a vacuum cleaner according to the present invention.

FIG. 2 is an exploded perspective view of a dust collecting unit of a vacuum cleaner according to the present invention.

Referring to FIG. 2, the dust collecting unit 300 is detachably mounted in the mounting portion 270 to function to filter foreign substances contained in the air introduced through the suction nozzle unit 100. The dust collecting unit 300 may employ a cyclone type collection unit, a filter type collection unit, or a combination of the cyclone and filter type collection units.

The dust collecting unit 300 is generally circular and includes a dust collection container 310 in which foreign substances are collected, top and bottom covers 320 and 330 that are detachably provided on a top and a bottom of the dust collection container 310 to cover the top and bottom, and a porous filter 350 detachably installed on a bottom of the bottom cover 330 to filter out foreign substances from the air introduced into the dust collection container 310.

The top cover 320 includes a circular exhaust hole 322 defined by punching a center portion of the top cover 320. Through the exhaust hole 322, the air is discharged after the foreign substances are filtered from the air. In front of the exhaust hole 322, a coupling groove 324 is depressed to a predetermined depth. The coupling groove 324 receives the coupling knob 260 to confine the dust collecting unit 300 in the main body 200 without separation.

The top cover 320 further includes a first hook (refer to 323 in FIG. 4) that is protruded downward with a predetermined curvature. One end of an elastic member (E) is hooked to the first hook 323, such that the elastic member (E) can be positioned in place without separation.

The dust collection container 310 is formed with a suction guide 312 on an outer surface. One end of the suction guide 312 is projected from the outer surface to a predetermined length to guide air into the dust collection container 310. The suction guide 312 is designed such that the air can be swirled in the dust collection container 310 in a tangential direction along an inner wall of the dust collection container 310. For this, the suction guide 312 is projected from the outer surface of the dust collection container 310 at an inclined angle.

A handle 314 with right angled portions is protruded from the outer surface of the dust collection unit 310 at a position opposing the suction guide 312, so that a user can easily grasp the dust collecting unit 300 by the handle 314 when the user separates the dust collecting unit 300 from the main body 200. Into an opened top of the handle 314, a pressing member 380 is inserted. For this, the pressing member 380 has an outer diameter corresponding to the inner diameter of the opened top of the handle 314. The pressing member 380 kept in the handle 314 is used when pressing a bar 370 downwardly.

The pressing member 380 includes a mounting rib (refer to 382 in FIG. 3) extended downwardly from a top end to a predetermined length. The mounting rib 382 corresponds to the opened top of the handle 314 such that the mounting rib 382 can be fitted around the opened top of the handle 314 when the pressing member 380 is inserted into the handle 314. Therefore, the pressing member 380 is not easily separated from the handle 314.

Between the dust collection container 310 and the top cover 320, an elastic rubber seal (S) is disposed to provide a hermetic sealing between the dust collection container 310 and the top cover 320. Preferable, the seal (S) has a shape corresponding to the shape of a top end of the dust collection container 310 such that the seal (S) can be tightly fitted when the top cover 320 closes the top end of the dust collection container 310.

The bottom cover 330, which is provided on the bottom of the dust collection container 310, includes a hinge 332 on a top for rotational motion and an opening button 340 opposite to the hinge 332 for controlling the opening and closing of the bottom cover 330. Therefore, when the opening button 340 is released, the bottom cover 330 can be rotated downwardly about the hinge 332 to open the dust collection container 310.

Figure 3:
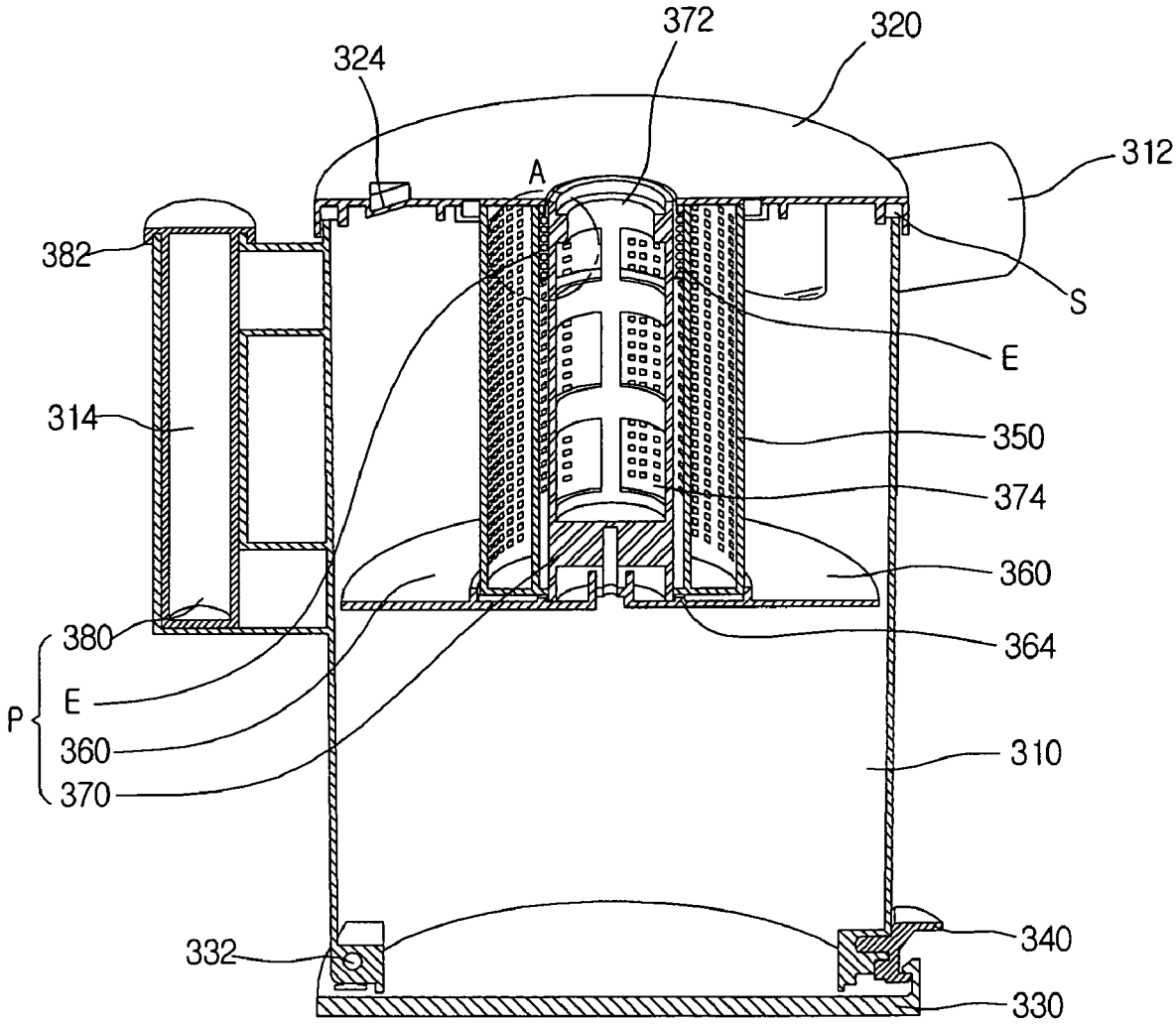
FIG. 3 is a sectional view taken along line I-I' in FIG. 1.

In the dust collection container 310, a foreign substance compressing unit (refer to (P) in FIG. 3) is installed. When depressed, the foreign substance compressing unit (P) moves downward to compress foreign substances collected in the dust collection container 310. The foreign substance compressing unit (P) can be depressed using the pressing member 380.

Figure 4:
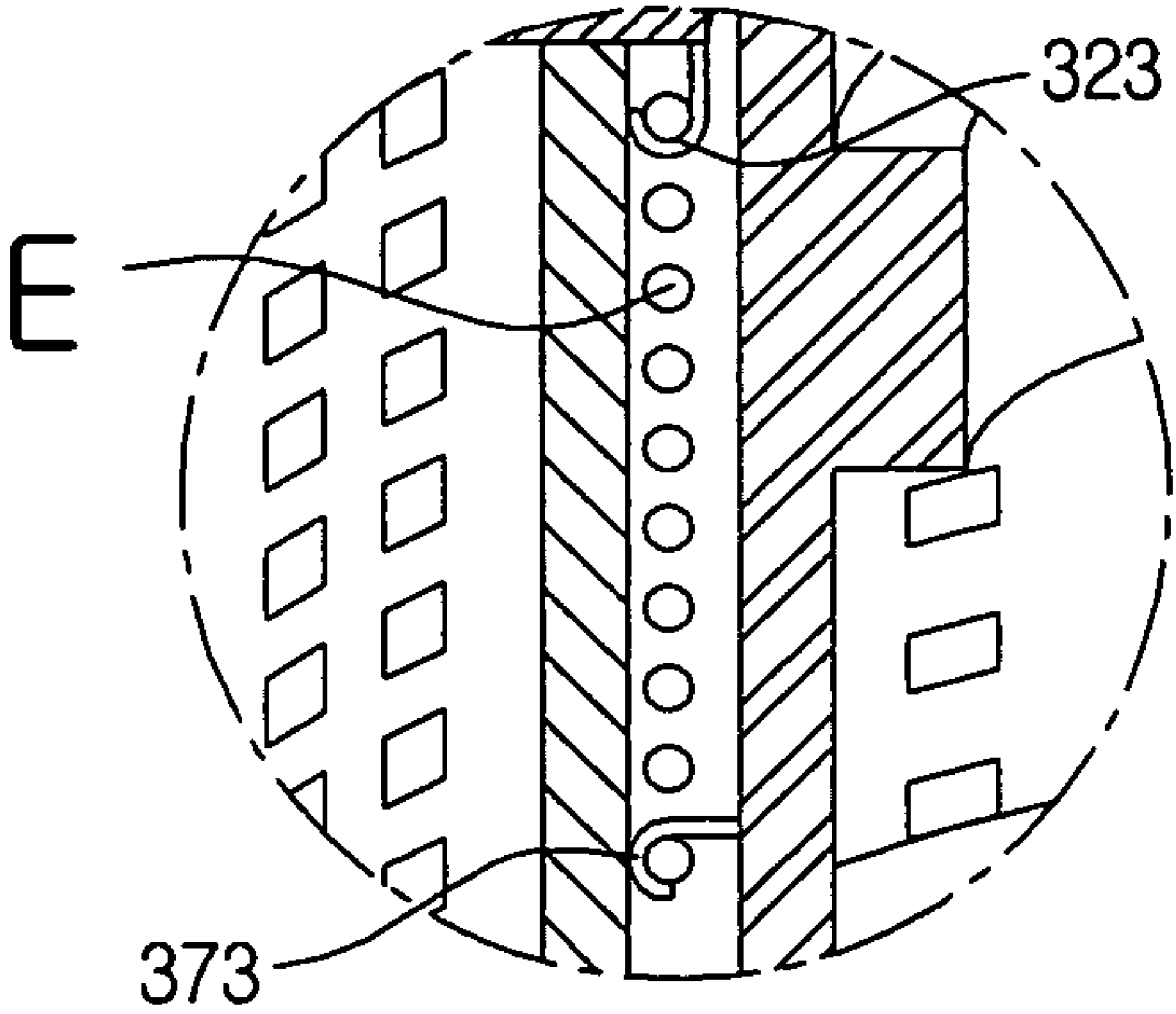
FIG. 4 is an enlarged view of the portion "A" in FIG. 3.

FIG. 3 is a sectional view taken along line I-I' in FIG. 1, and FIG. 4 is an enlarged view of the portion "A" in FIG. 3. The structure of the foreign substance compressing unit (p) will now be more fully described with reference to FIGS. 2, 3, and 4.

The foreign substance compressing unit (P) includes a compartment plate 360 disposed under the filter 350 to divide the inner space of the dust collection container up and down, the bar 370 jointed to the compartment plate 360 and capable of moving up and down in the filter 350 to guide the movement of the compartment plate 360, the elastic member (E) disposed around the bar 370 to provide a restoring force when the bar 370 is moved downward, and the depressing member 380.

In detail, the compartment plate 360 is jointed to a bottom of the bar 370 and divides the inner space of the dust collection container 310 up and down. The compartment plate 360 has a circular shape with an outer diameter corresponding to the inner diameter of the dust collection container 310. Therefore, the compartment plate 360 can prevent the foreign substances fallen through falling holes 362 defined in a circumference of the compartment plate 360 from reversely moving up. The upper space of the dust collection container 310 divided by the compartment plate 260 is used as a foreign substance separating compartment in which the foreign substances are separated from the air by utilizing the cyclone effect, and the lower space of the dust collection container 310 divided by the compartment plate 360 is used as a foreign substance storing compartment in which the separated foreign substances are stored.

The compartment plate 360 includes a bar receiving rib 364 formed on a top surface to a predetermined height. The bar receiving rib 364 has an inner diameter corresponding to the outer diameter of the bar 370, such that when the bar 370 is inserted into the bar receiving rib 364, the compartment plate 360 can be prevented from separation from the bar 370. The bar 370 may be tight fitted into the bar receiving rib 364 to prevent separation. Further, permanent coupling methods such as an adhesion method can be used to couple the bar 370 and the compartment plate 360.

A foreign substance blocking rib 366 is protruded around the bar receiving rib 364. The foreign substance blocking rib 366 is spaced a predetermined distance from the bar receiving rib 364 and has an inner diameter corresponding to the outer diameter of a lower end of the filter 350. The inner surface of the foreign substance blocking rib 366 makes contact with the outer surface of the filter 350 to prevent the foreign substances from entering through a gap under the filter 350.

The bar 370 has a cylindrical shape with an opened top and a length corresponding to the length of the filter 350. Since the lower end of the bar 370 is fixedly inserted into the bar receiving rib 364, the bar 370 and the compartment plate 360 can be moved together in up and down directions. Therefore, the foreign substances collected on a bottom of the dust collection container 310 can be compressed by the compartment plate 360 when the bar 370 is moved downward. When compressed, the collected foreign substances become dense and tangled.

The bar 370 includes a support rib 372 that is inwardly protruded along an inner surface of a top end. The support rib 372 makes contact with the pressing member 380 when the bar is pushed down by the pressing member 380. For this, it is preferable that the support rib 372 has an inner diameter smaller than the outer diameter of a lower end of the pressing member 380. When the lower end of the pressing member 380 depresses the support rib 372 downwardly, the entire bar 370 can be moved downward.

The bar 370 further includes a second hook 373 formed on an outer surface with a predetermined curvature. The shape of the second hook 373 is similar to that of the first hook 323 formed on the top cover 320. Since the top bottom ends of the elastic member (E) are hooked by the first and second hooks 373, the elastic member (E) can apply a restoring force to the bar 370 when the bar 370 is moved down. In detail, when the bar 370 is moved down by the pressing member 380, the elastic member (E) is elongated since the top and bottom ends of the elastic member (E) are hooked by the first and second hook 323 and 373. Therefore, when the depressing force of the pressing member 380 is removed, the bar 370 can be return to its original position by the restoring force of the elongated elastic member (E).

The bar 370 further includes rectangular air holes 374 along its outer surface. The air introduced into the filter 350 is guided by the air holes 374 toward the exhaust hole 322 of the top cover 320. Preferably, the number and size of the air holes 374 are adjusted such that the air can be guided without disturbance.

Figure 5:
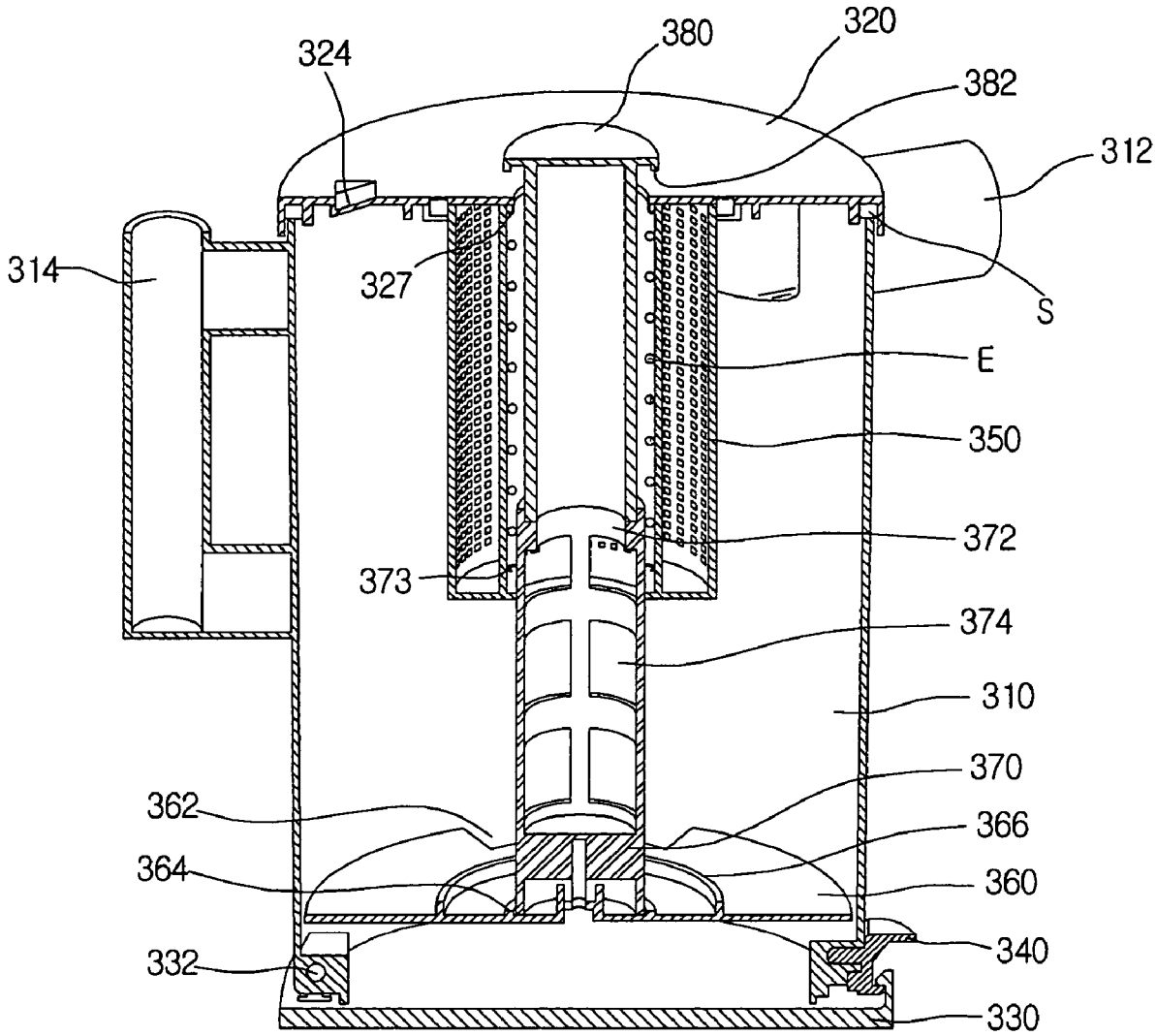
FIG. 5 is a view showing the operation of a foreign substance compressing unit in a dust collecting unit of a vacuum cleaner according to the present invention.

The operation of the vacuum cleaner and the dust collecting unit will now be more fully described with reference to FIGS. 1 to 5. Particularly, FIG. 5 is a side sectional view showing a dust collecting unit of a vacuum cleaner when a foreign substance compressing unit is operated in the dust collecting unit according to the present invention.

When the vacuum cleaner is powered on, the motor (not shown) installed in the main body 200 rotates to generate suction force. By the suction force of the motor, the air containing foreign substances is sucked through the suction nozzle unit 100, and the sucked air is guided by the suction guide 312 of the dust collecting unit 300 into the dust collection container 310.

In the dust collection container 310, the air swirls along the inner wall of the dust collection container 310. While the air swirls, relatively heavier foreign substances fall down through the falling holes 362 of the compartment plate 360 toward the bottom of the dust collection container 310, and relatively lighter foreign substances swirl along the circumference of the filter 350 and filtered by the filter 350.

After swirling along the inner wall of the dust collection container 310, the air enters the filter 350 and goes outside of the filter 350 through the air holes 374 and the exhaust hole 322 to the outside of the dust collecting unit 300. The air discharged to the outside of the dust collecting unit 300 passes through the motor, and then the air is discharged to the outside of the vacuum cleaner through a discharge outlet 290 formed in the outer surface of the main body 200. In this way, the vacuum cleaner operates.

Meanwhile, if the foreign substances are accumulated in the dust collection container 310 at a low density, the volume of the accumulated foreign substances is relatively large when compared with the amount of the accumulated foreign substances. Therefore, the accumulated foreign substances take much space in the dust collection container 310 to deteriorate the outside appearance and the dust collecting efficiency of the dust collecting unit 300. To prevent above-mentioned problems, the foreign substance compressing unit (P) is operated to compress the foreign substances accumulated at a low density.

To operate the foreign substance compressing unit (P), first, the pressing member 380 is pulled out of the handle 314. Then, the lower end of the pressing member 380 is inserted into the top end of the bar 370 while the top end of the pressing member 380 is grasped.

Here, the lower end of the pressing member 380 makes contact with the top surface of the support rib 372 of the bar 370, such that the bar 370 can be moved down when the pressing member 380 is depressed by a user.

When the bar 370 is moved down, the compartment plate 360 joined to the lower end of the bar 370 is also moved down. While the compartment plate 360 moves downward, the compartment plate 360 compresses the foreign substances accumulated on the bottom of the dust collection container 310 to decrease the volume of the accumulated foreign substances, that is, to increase the density of the accumulated foreign substances.

Meanwhile, when the depressing force acting on the pressing member 380 is removed after the accumulated foreign substances are compressed, the bar 370 and the compartment plate 360 are moved upward to their original positions by the restoring force of the elastic member (E). Therefore, the dust collecting unit 300 can operated again.

According to the present invention, the inside space of the dust collection container can be efficiently used, so that it is not needed to frequently empty the dust collection container. Further, since the foreign substances collected in the dust collection container is compressed, dust does not generate when the dust collection container is emptied. Furthermore, the foreign substance collecting operation by the cyclone effect is not disturbed by the collected foreign substances since the collected foreign substances are densely compressed. Thus, the foreign substance collecting efficiency can be kept constant for a long time.

In addition, the collected foreign substances are densely compressed at a predetermined position, so that the visual image can be improved.

It will be apparent to those skilled in the art that various modifications and variations can be made in the present invention. Thus, it is intended that the present invention covers the modifications and variations of this invention provided they come within the scope of the appended claims and their equivalents.

For example, although the upright type vacuum cleaner is exampled in the embodiments, the present invention is not limited to this case. That is, the present invention can be applied to the canister type vacuum cleaner or other types of vacuum cleaners to increase the foreign substance collecting efficiency.

Further, the present invention can be applied to any types of dust collecting units to compress collected foreign substances. That is, the present invention is not limited to the cyclone type dust collecting unit.

Furthermore, though the filter is used and the bar is guided along a center of the filter according to the exemplary embodiments, the present invention is not limited to this case. That is, the present invention can be applied to a dust collecting unit that does not have a filter. In this case, for example, a pushing rod and a compressing plate jointed to a lower end of the pushing rod can be used to compress collected foreign substances.

What is claimed is:

1. A dust collecting unit of a vacuum cleaner, comprising:
- a dust collection container collecting foreign substances;
- a top cover closing a top of the dust collection container;
- a bottom cover closing a bottom of the dust collection container;
- a compartment plate dividing an inner space of the dust collection container into a foreign substance separating compartment and a foreign substance storing compartment;
- a bar pushing the compartment plate to the foreign substance storing compartment to compress the foreign substances stored in the foreign substance storing compartment; and
- a pressing member detachably coupled to the dust collection container to depress a top end of the bar.

2. The dust collecting unit according to claim 1, wherein the bar includes:
- a top end supported with respect to the top cover; and
- a bottom end supported by the compartment plate.

3. The dust collecting unit according to claim 1, wherein the bar is moved in a direction perpendicular to the top cover.

4. The dust collecting unit according to claim 1, wherein the top end of the bar is exposed through the top cover.

5. The dust collecting unit according to claim 4, wherein the pressing member is kept in a handle formed on an outer surface of the dust collection container.

6. The dust collecting unit according to claim 1, further comprising a porous filter disposed around the bar to further filter out the foreign substances from air passed through the foreign substance separating compartment.

7. The dust collecting unit according to claim 6, wherein the compartment plate includes a foreign substance blocking rib on a top surface adjacent to the filter.

8. The dust collecting unit according to claim 1, further comprising an elastic member having at least one end connected to the bar to elastically support the bar.

9. The dust collecting unit according to claim 8, wherein the elastic member has the other end connected to the top cover.

10. The dust collecting unit according to claim 1, wherein the bar has a hollow cylindrical shape formed with an air hole to allow air to discharge therethough from the dust collection container.

11. The dust collecting unit according to claim 1, wherein the bar is fixed to the compartment plate by tight fitting.

12. The dust collecting unit according to claim 1, wherein the bottom cover is hinged on the dust collection container for discharging the collected foreign substances.

13. A dust collecting unit of a vacuum cleaner, comprising:

a dust collection container separating and collecting foreign substances;

a handle formed on an outer surface of the dust collection container;

a top cover closing a top of the dust collection container;

a bottom cover closing a bottom of the dust collection container;

a foreign substance compressing unit receiving an external force to push the collected foreign substances to a side in the dust collection container to compress the foreign substances, wherein the foreign substance compressing unit comprises a compartment plate dividing an inner space of the dust collection container into up and down compartments;

a bar pushing the compartment plate downwardly; and a pressing member detachably coupled to the container for pushing the bar.

14. The dust collecting unit according to claim 13, wherein the foreign substance compressing unit further comprises:

an elastic member having an end connected to the bar to apply a restoring force to the bar in an upward direction.

15. The dust collecting unit according to claim 14, wherein the elastic member has the other end hooked by the top cover.

16. The dust collecting unit according to claim 13, wherein the pressing member is kept in the handle.

17. The dust collecting unit according to claim 14, wherein the bar has a hollow shape formed with an air hole to allow air to discharge therethough from the dust collection container.

18. A dust collecting unit of a vacuum cleaner, comprising:

a dust collection container separating and collecting foreign substances;

a top cover closing a top of the dust collection container;

a bottom cover closing a bottom of the dust collection container;

a compartment plate dividing an inner space of the dust collection container into an upper foreign substance separating compartment and a lower foreign substance storing compartment;

a bar pushing the compartment plate to the foreign substance storing compartment to compress the foreign substances stored in the foreign substance storing compartment;

a filter closely disposed around the bar to further filter out the foreign substances from air passed through the foreign substance separating compartment and to guide the bar therethrough; and a pressing member detachably coupled to the dust collection container to depress the top end of the bar.

19. A dust collecting unit of a vacuum cleaner, comprising:

a dust collection container separating and collecting foreign substances;

a compartment plate dividing an inner space of the dust collection container into an upper foreign substance separating compartment and a lower foreign substance storing compartment;

a bar pushing the compartment plate to the foreign substance storing compartment to compress the foreign substances stored in the foreign substance storing compartment;

a filter closely disposed around the bar to further filter out the foreign substances from air passed through the foreign substance separating compartment and to guide the bar therethrough;

a handle integrally formed with the dust collection container; and a pressing member detachably coupled to the dust collection container for pushing the bar.

* * * * *